US011578465B2

(12) United States Patent
Xu et al.

(10) Patent No.: US 11,578,465 B2
(45) Date of Patent: Feb. 14, 2023

(54) TEMPORARY SUPPORT SYSTEM FOR ROAD BRIDGE PRE-FABRICATED SMALL BOX GIRDER-TYPE CONCEALED BENT CAP, AND METHOD OF CONSTRUCTING SAME

(71) Applicant: Ningbo Municipal Engineering Construction Group Co., Ltd., Zhejiang (CN)

(72) Inventors: Shengliang Xu, Zhejiang (CN); Jufeng Chen, Zhejiang (CN)

(73) Assignee: Ningbo Municipal Engineering Construction Group Co., Ltd., Zhejiang (CN)

( * ) Notice: Subject to any disclaimer, the term of this patent is extended or adjusted under 35 U.S.C. 154(b) by 0 days.

(21) Appl. No.: 17/630,513

(22) PCT Filed: Dec. 18, 2020

(86) PCT No.: PCT/CN2020/137473

§ 371 (c)(1),
(2) Date: Jan. 27, 2022

(87) PCT Pub. No.: WO2021/078309

PCT Pub. Date: Apr. 29, 2021

(65) Prior Publication Data

US 2022/0243409 A1 Aug. 4, 2022

(30) Foreign Application Priority Data

Oct. 21, 2019 (CN) ..... 201911001747.8

(51) Int. Cl.
*E01D 21/00* (2006.01)
*E01D 2/04* (2006.01)
*E01D 19/02* (2006.01)

(52) U.S. Cl.
CPC ..... *E01D 21/00* (2013.01); *E01D 2/04* (2013.01); *E01D 19/02* (2013.01)

(58) Field of Classification Search
CPC ..... E01D 2/04; E01D 19/02; E01D 21/00
(Continued)

(56) References Cited

U.S. PATENT DOCUMENTS 8,522,381 B1 * 9/2013 Smith ..... E01D 22/00 52/745.18
2011/0016645 A1 * 1/2011 Porter ..... E01D 22/00 405/232

FOREIGN PATENT DOCUMENTS

CN 101538831 9/2009
CN 204530483 8/2015
(Continued)

OTHER PUBLICATIONS

"International Search Report (Form PCT/ISA/210) of PCT/CN2020/137473," dated Mar. 17, 2021, with English translation thereof, pp. 1-6.

(Continued)

*Primary Examiner* — Raymond W Addie
(74) *Attorney, Agent, or Firm* — JCIP Global Inc.

(57) ABSTRACT

A temporary support system for a road bridge pre-fabricated small box girder-type concealed bent cap, and a method of constructing same. The support system comprises a main beam, a main pier support system, and a lateral pier support system; the main beam is arranged on the transverse side of road bridge piers; the main pier support system is disposed on the transverse side of a main pier area and is located under the main beam; the lower end of the main pier support system is fixed to a main pier bearing platform, whereas the upper end is fixed to the main beam; the lateral pier support system is disposed on the transverse side of a lateral pier area and is located below the main beam; and the lower end
(Continued)

of the lateral pier support system is fixed to a lateral pier bearing platform, whereas the upper end is fixed to the main beam.

10 Claims, 8 Drawing Sheets

(58) Field of Classification Search
USPC ..... 14/77.1, 77.3
See application file for complete search history.

(56) References Cited

FOREIGN PATENT DOCUMENTS

| | | |
|---|---|---|
| CN | 107653781 | 2/2018 |
| CN | 107881924 | 4/2018 |
| CN | 110747746 | 2/2020 |
| CN | 110747761 | 2/2020 |
| CN | 212052326 | 12/2020 |
| CN | 212052327 | 12/2020 |
| KR | 101024259 | 3/2011 |

OTHER PUBLICATIONS

"Written Opinion of the International Searching Authority (Form PCT/ISA/237) of PCT/CN2020/076758," dated Mar. 17, 2021, with English translation thereof, pp. 1-10.

* cited by examiner

TEMPORARY SUPPORT SYSTEM FOR ROAD BRIDGE PRE-FABRICATED SMALL BOX GIRDER-TYPE CONCEALED BENT CAP, AND METHOD OF CONSTRUCTING SAME

CROSS-REFERENCE TO RELATED APPLICATION

This application is a 371 of international application of PCT application serial no. PCT/CN2020/137473, filed on Dec. 18, 2020, which claims the priority benefit of China application no. 201911001747.8, filed on Oct. 21, 2019. The entirety of each of the above mentioned patent applications is hereby incorporated by reference herein and made a part of this specification.

BACKGROUND

Technical Field

The present invention relates to a support system for a road bridge, and in particular, to a temporary support system for a road bridge pre-fabricated small box girder-type concealed bent cap.

The present invention further relates to a method of constructing the foregoing temporary support system for a road bridge pre-fabricated small box girder-type concealed bent cap.

Description of Related Art

Generally, for main bridges with the same area, the approximate cost of using cast-in-place box girders is greater than the approximate cost of using pre-fabricated small box girders. Therefore, in terms of cost saving, the construction cost can be greatly reduced by choosing pre-fabricated small box girders for constructing a bridge deck of a road bridge. In addition, such a construction manner can further reduce the construction period.

When the bridge deck of the road bridge is constructed by using pre-fabricated small box girders, a plurality of pre-fabricated small box girders parallel to each other span two adjacent bridge piers in the longitudinal direction of the bridge deck (the length extension direction of the bridge deck). Pre-fabricated small box girders between two adjacent spans need to be spliced by a bent cap to implement the continuous pavement of the bridge deck.

During the construction of the foregoing bridge deck of the road bridge, a support system needs to be built in advance. For example, in a method of constructing a post-cast concealed bent cap for transforming a simply-supported girder into a continuous girder in Chinese Patent CN101538831A, a temporary support system is disclosed, in which Φ273×7 triple steel pipes are used as a vertical support (a pillar spacing is 12.5 m), and double 56a I steel is disposed as a temporary support girder for a hollow slab girder. In addition, to reduce a support girder span, a diagonal strut is added at the bottom of the vertical support, and various connecting rods are arranged for the diagonal strut to reduce a calculated length of the diagonal strut and improve the overall stability of a bracket system, so that the lower support forms a truss system. Because the support system is designed for the construction of a road bridge with a main bridge being a PC hollow slab girder (a span is 20 m, a girder height is 90 cm, and the weight of a single girder is 22.2 tons), for the construction of a road bridge with a main bridge being a pre-fabricated small box girder (90 ton/piece, which is more than three times the weight of a PC hollow slab girder). Such a support system has a limited load-bearing capacity and is therefore not applicable. In addition, more importantly, the support system is limited to the area of a bearing platform, and in the used truss system, to reduce a length ratio of a main support pillar, dense rod members are disposed in a support area. During construction, vehicles (used for transporting components or pre-fabricated small box girders of the support system) cannot pass. As a result, the assembly and disassembly of the support system are required, and it is impossible to adequately increase the transportation capacity to improve the construction efficiency of the bridge deck.

SUMMARY

In view of the deficiencies in the prior art, the present invention provides a temporary support system for a road bridge pre-fabricated small box girder-type concealed bent cap. In the system, a main pier support system is arranged in a main pier area, a lateral pier support system is arranged in lateral pier areas, and the main pier support system and the lateral pier support system are connected by a main beam that is located above the main pier support system and the lateral pier support system and is arranged in the transverse direction of a bridge deck of a road bridge, to form the overall support system for a pre-fabricated small box girder-type concealed bent cap. As can be seen, in the overall support system of the present invention, between the main pier area and the lateral pier area there is only a large-span support girder (main beam) arranged in the transverse direction, and no other support systems arranged in the vertical direction. This allows for vehicle operating space, and thus facilitates assembly and disassembly of the present support system for a pre-fabricated small box girder-type concealed bent cap. In addition, the overall support system of the present invention has a high load-bearing capacity, thus meeting support requirements for pre-fabricated small box girder-type concealed bent caps.

To achieve the foregoing technical objectives, the present invention adopts the following technical solutions:

A temporary support system for a road bridge pre-fabricated small box girder-type concealed bent cap includes a main beam, a main pier support system, and a lateral pier support system, where the main beam is arranged on the transverse side of road bridge piers, and the road bridge piers include a main pier and a lateral pier; the main pier support system is disposed on the transverse side of a main pier area and is located under the main beam; the lower end of the main pier support system is fixed to a main pier bearing platform, whereas the upper end is fixed to the main beam; the lateral pier support system is disposed on the transverse side of a lateral pier area and is located below the main beam; and the lower end of the lateral pier support system is fixed to a lateral pier bearing platform, whereas the upper end is fixed to the main beam.

Further, a number of the main beam is two, and the main beams respectively are a first main beam and a second main beam; the first main beam and the second main beam are symmetrically separately disposed on two sides of the road bridge piers in the transverse direction, and the first main beam and the second main beam are connected by a connecting member; a number of the main pier support system is two, and the main pier support system are respectively a first main pier support system and a second main pier support system; the first main pier support system and the second main pier support system are symmetrically separately disposed on two sides of the road bridge piers in the transverse direction; the lower ends of the first main pier support system and the second main pier support system are both fixed to the main pier bearing platform, the upper end of the first main pier support system is fixed to the first main beam, and the upper end of the second main pier support system is fixed to the second main beam; a number of the lateral pier support systems is two, and the lateral pier support systems are respectively a lateral pier support system a and a lateral pier support system b; and the lateral pier support system a and the lateral pier support system b are symmetrically separately disposed on two sides of the road bridge piers in the transverse direction, the lower ends of the lateral pier support system a and the lateral pier support system b are both fixed to the lateral pier bearing platform, the upper end of the lateral pier support system a is fixed to the first main beam, and the upper end of the lateral pier support system b is fixed to the second main beam.

Further, the main pier support system includes a main pier pad beam, a main pier vertical support, and a main truss system, where the main truss system includes a top chord slab, a bottom chord slab, and a W-shaped truss disposed between the top chord slab and the bottom chord slab; three endpoints of the upper end of the W-shaped truss are all connected and fixed to corresponding positions on the lower surface of the top chord slab, to respectively form a joint site A, a joint site B, and a joint site C; two endpoints of the lower end of the W-shaped truss are respectively connected and fixed to corresponding positions on the upper surface of the bottom chord slab, to respectively form a joint site E and a joint site F; the upper surface of the top chord slab can be connected to the main beam by a detachable connecting member a; the main pier pad beam is disposed on the transverse side of the road bridge piers and is fixed to the main pier bearing platform; a number of the main pier vertical supports is two, and the main pier vertical supports are respectively a first main pier vertical support and a second main pier vertical support, both disposed between the lower end of the W-shaped truss and the pad beam; and the upper ends of the first main pier vertical support and the second main pier vertical support can both be connected and fixed to the lower surface of the bottom chord slab by a detachable connecting member b, whereas the lower ends of the first main pier vertical support and the second main pier vertical support can be fixed to the main pier pad beam by a detachable connecting member c.

Further, a joint site between the first main pier vertical support and the bottom chord slab is disposed corresponding to a position of the joint site E, and a joint site between the second main pier vertical support and the bottom chord slab is disposed corresponding to a position of the joint site F.

Further, the upper surface of the top chord slab is provided with three connecting portions, including a connecting portion a, a connecting portion b, and a connecting portion c; the connecting portion a corresponds to the joint site A, the connecting portion b corresponds to the joint site B, and the connecting portion c corresponds to the joint site C; and the connecting portion a, the connecting portion b, and the connecting portion c can all be connected to the main beam by the detachable connecting member a.

Further, the lateral pier support systems include a lateral pier vertical support; and the upper end of the lateral pier vertical support is fixed and connected to the main beam, whereas the lower end is fixed to the lateral pier bearing platform.

Further, a number of the lateral piers is two, and the lateral piers are respectively a first lateral pier and a second lateral pier, symmetrically distributed on two sides of the main pier; the area of the first lateral pier and the area of the second lateral pier are respectively correspondingly provided with a first lateral pier support system and a second lateral pier support system; the upper end of the first lateral pier support system is fixed to the main beam, whereas the lower end is fixed to the lateral pier bearing platform of the first lateral pier; and the upper end of the second lateral pier support system is fixed to the main beam, whereas the lower end is fixed to the lateral pier bearing platform of the second lateral pier.

Further, the system further includes two cantilever beams, correspondingly mounted at two ends of the main beam in the length direction by a detachable connection.

Another technical objective of the present invention is to provide a method of constructing a cantilever support system for a road bridge pre-fabricated small box girder-type concealed bent cap, including the following steps:

(1) pre-fabricating members:

separately pre-fabricating the following members: one main beam section a, one main beam section b, one main truss system, two main pier vertical supports, one main pier pad beam, one lateral pier vertical support, and two cantilever beams, where the two main pier vertical supports are a first main pier vertical support and a second main pier vertical support; and the two cantilever beams are a first cantilever beam and a second cantilever beam;

(2) mounting the main pier pad beam, the first main pier vertical support, the second main pier vertical support, and the lateral pier vertical support:

hoisting the main pier pad beam to one side of a main pier bearing platform in the transverse direction, adjusting a position of the main pier pad beam on the main pier bearing platform, until a mounting hole A and a mounting hole B in the main pier pad beam are respectively aligned with a mounting hole a and a mounting hole b provided in the main pier bearing platform, and then fixing the main pier pad beam on the main pier bearing platform by welding fixation; next, hoisting the first main pier vertical support onto the main pier pad beam first, placing the first main pier vertical support sequentially through the mounting hole A in the main pier pad beam and the mounting hole a in the main pier bearing platform, and then using a bolt fastening member to fix the lower end of the first main pier vertical support on the main pier bearing platform through the main pier pad beam; subsequently hoisting the second main pier vertical support onto the main pier pad beam, sequentially placing the second main pier vertical support through the mounting hole B in the main pier pad beam and the mounting hole b in the main pier bearing platform, and then using a bolt fastening member to fix the lower end of the second main pier vertical support on the main pier bearing platform through the main pier pad beam; and hoisting the lateral pier vertical support above a lateral pier bearing platform, enabling the lower end of the lateral pier vertical support to be placed through a mounting hole c provided in the lateral pier bearing platform, and then fixing the lateral pier vertical support on the lateral pier bearing platform by welding;

(3) constructing the main truss system:

hoisting the main truss system above the first main pier vertical support and the second main pier vertical support, and using a bolt fastening member to separately fix a bottom chord slab of the main truss system to the upper end of the first main pier vertical support and the upper end of the second main pier vertical support;

(4) constructing the main beam section a to be joined to the main truss system:

hoisting the main beam section a to a top chord slab of the main truss system, and adjusting a position of the main beam section a on the top chord slab, until a bolt fastening member can be used to fix the main beam section a to the top chord slab;

(5) constructing the main beam section b with one end to be supported on the lateral pier bearing platform:

hoisting the main beam section b above the lateral pier support system, and adjusting a position of the main beam section b, until one end of the main beam section b can be spliced to the main beam section a, whereas the other end can be fixed to the upper end of the lateral pier support system by a bolt fastening member; and (6) constructing the cantilever beams:

separately hoisting the first cantilever beam and the second cantilever beam in position, then using a detachable connecting member to fix the first cantilever beam to an outer-side end portion of the main beam section a, and using a detachable connecting member to fix the second cantilever beam to an outer-side end portion of the main beam section b.

Still another technical objective of the present invention is to provide a method of constructing a large-span support system for a road bridge pre-fabricated small box girder-type concealed bent cap, including the following steps:

(1) pre-fabricating members:

separately pre-fabricating the following members: one main beam section a, two main beam sections b, one main truss system, two main pier vertical supports, one main pier pad beam, two lateral pier vertical supports, and two cantilever beams, where the two main pier vertical supports are a first main pier vertical support and a second main pier vertical support; and the two cantilever beams are a first cantilever beam and a second cantilever beam;

the two main beam sections b are a first main beam section b and a second main beam section b; and the two lateral pier vertical supports are a first lateral pier vertical support and a second lateral pier vertical support;

(2) mounting the main pier pad beam, the first main pier vertical support, the second main pier vertical support, the first lateral pier vertical support, and the second lateral pier vertical support: hoisting the main pier pad beam to one side of a main pier bearing platform in the transverse direction, adjusting a position of the main pier pad beam on the main pier bearing platform, until a mounting hole A and a mounting hole B in the main pier pad beam are respectively aligned with a mounting hole a and a mounting hole b provided in the main pier bearing platform, and then fixing the main pier pad beam on the main pier bearing platform by welding fixation; next, hoisting the first main pier vertical support onto the main pier pad beam first, placing the first main pier vertical support sequentially through the mounting hole A in the main pier pad beam and the mounting hole a in the main pier bearing platform, and then using a bolt fastening member to fix the lower end of the first main pier vertical support on the main pier bearing platform through the main pier pad beam; subsequently hoisting the second main pier vertical support onto the main pier pad beam, sequentially placing the second main pier vertical support through the mounting hole B in the main pier pad beam and the mounting hole b in the main pier bearing platform, and then using a bolt fastening member to fix the lower end of the second main pier vertical support on the main pier bearing platform through the main pier pad beam; and hoisting the first lateral pier vertical support above a lateral pier bearing platform of a first lateral pier, enabling the lower end of the first lateral pier vertical support to be placed through a mounting hole c provided in the lateral pier bearing platform of the first lateral pier, and then fixing the first lateral pier vertical support to the lateral pier bearing platform of the first lateral pier by welding; and hoisting the second lateral pier vertical support above the lateral pier bearing platform of a second lateral pier, enabling the lower end of the second lateral pier vertical support to be placed through a mounting hole d provided in the lateral pier bearing platform of the second lateral pier, and then fixing the second lateral pier vertical support to the lateral pier bearing platform of the second lateral pier by welding;

(3) constructing the main truss system:

hoisting the main truss system above the first main pier vertical support and the second main pier vertical support, and using a bolt fastening member to separately fix a bottom chord slab of the main truss system to the upper end of the first main pier vertical support and the upper end of the second main pier vertical support;

(4) constructing the main beam section a to be joined to the main truss system:

hoisting the main beam section a to a top chord slab of the main truss system, and adjusting a position of the main beam section a on the top chord slab, until a bolt fastening member can be used to fix the main beam section a to the top chord slab;

(5) constructing the first main beam section b with one end to be supported on the lateral pier bearing platform of the first lateral pier, and constructing the second main beam section b with one end to be supported on the lateral pier bearing platform of the second lateral pier:

hoisting the first main beam section b above a first lateral pier support system, and adjusting a position of the first main beam section b, until one end of the first main beam section b can be spliced to one end of the main beam section a, whereas the other end can be fixed to the upper end of the first lateral pier support system by a bolt fastening member; and hoisting the second main beam section b above a second lateral pier support system, and adjusting a position of the second main beam section b, until one end of the second main beam section b can be spliced to the other end of the main beam section a, whereas the other end of the second main beam section b can be fixed to the upper end of the second lateral pier support system by a bolt fastening member; and (6) constructing the cantilever beams:

separately hoisting the first cantilever beam and the second cantilever beam in position, then using a detachable connecting member to fix the first cantilever beam to an outer-side end portion of the first main beam section b, and using a detachable connecting member to fix the second cantilever beam to an outer-side end portion of the second main beam section b.

According to the foregoing technical solution, compared with the prior art, the present invention has the following advantages:

1. After a pre-fabricated small box girder is hoisted in position and the casting of the concealed bent cap is completed, the temporary support system in the present invention is removed by using a specific assembly and disassembly apparatus. The main pier support system constructed in the main pier area and the lateral pier support systems constructed in the lateral pier area jointly support the main beam to form the support system. As can be seen, in the support system in the present invention, there is relatively large space between the main pier and a lateral pier, thus facilitating the passage of hoisting equipment (cranes), to facilitate the hoisting of the members of the support system, and especially, to facilitate subsequent assembly and disassembly of the members.

2. Because a bridge deck of the present invention uses a pre-fabricated small box girder, the bearing of the temporary support system can be implemented in the following manners: (1) increasing the girder height of the main beam; (2) arranging piers in the middle, and reducing spans; and (3) using a support system with a specific structure.

Because the support system in the present invention is a temporary support system and needs to be removed in a specific stage after construction, the use of the first manner (increasing the girder height of the main beam) to ensure the bearing capacity of the temporary support system has the following deficiencies: 1. Steel usage is increased, and the manufacturing cost is increased. 2. The structure of the main beam has increased steel usage, and there are more steps during removal, that is, the assembly and disassembly cost is incurred. As can be seen, the use of the first manner to ensure the bearing capacity of the temporary support system is not economical. The use of the second manner (arranging piers in the middle, and reducing spans) to ensure the bearing capacity of the temporary support system has a major problem that subsequent pile extraction is difficult. Therefore, after comprehensive consideration, the present invention uses the third manner (using a support system with a specific structure) to ensure the bearing capacity of the temporary support system, specifically:

In the support system in the present invention, a main pier support system with a specific structural form is disposed. A W-shaped truss is disposed in the main pier area in the main pier support system to reduce the negative bending moment at the fulcrum of the support girder, so that a maximum force (bending moment) area in the main beam has more uniform bending moment distribution, thereby reducing steel usage of the main beam and providing a high load-bearing capacity.

DESCRIPTION OF THE EMBODIMENTS

Figure 1:
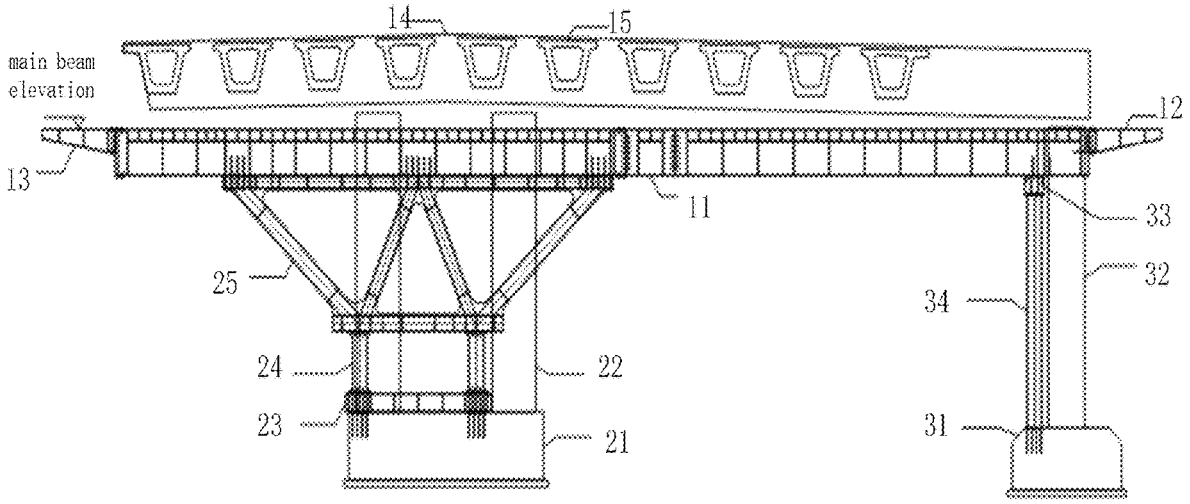
FIG. 1 is a schematic structural diagram of a temporary cantilever support system for a road bridge pre-fabricated small box girder-type concealed bent cap according to Embodiment 1 of the present invention.

The following clearly and completely describes the technical solutions in the embodiments of the present invention with reference to the accompanying drawings in the embodiments of the present invention. Apparently, the described embodiments are only some embodiments of the present invention rather than all the embodiments. The following description of at least one exemplary embodiment is merely illustrative in nature and is in no way intended to pose any limitation on the present invention and its application or use. All other embodiments obtained by persons of ordinary skill in the art based on the embodiments of the present invention without creative efforts fall within the protection scope of the present invention. Unless specifically stated otherwise, the relative arrangements, expressions, and values of the components and steps set forth in these embodiments do not limit the scope of the present invention. In addition, it should be understood that for ease of description, the dimensions of the various parts shown in the drawings are not drawn in accordance with actual scale relationships. Techniques, methods, and apparatuses known to those of ordinary skill in the relevant art may not be discussed in detail, but the techniques, methods and apparatuses should be considered as part of the authorized specification if appropriate. In all examples shown and discussed herein, any specific value should be interpreted to be illustrative only but not restrictive. Therefore, other examples of the exemplary embodiments may have different values.

For ease of description, spatially relative terms such as "on", "above", "on the surface of", "upper", etc. may be used herein to describe a spatial positional relationship between one device or feature and another device or feature as shown in the figures. It should be understood that the spatially relative terms are intended to encompass different orientations of the device in use or operation in addition to the orientation of the device depicted in the figures. For example, if a device in the figures is turned upside down, the device described as "above other devices or structures" or "on other devices or structures" will be positioned as "below other devices or structures" or "under other devices or structures". Thus, the exemplary term "above" may include both orientations of "above" and "below". The device may also be positioned in other different manners (the device is rotated by 90 degrees or positioned in other orientations).

Embodiment 1

As shown in FIG. 1, this embodiment discloses a cantilever support system, used for supporting a road bridge pre-fabricated small box girder-type concealed bent cap. The support system includes a main beam 11, a main pier support system, and lateral pier support systems.

The main beam 11 is arranged on the transverse side of ("transverse" refers to the width direction of a bridge deck of a road bridge, that is, the horizontal direction in FIG. 1) road bridge piers, and is formed by splicing two sections, including a main beam section a supported by the main pier support system and a main beam section b with one end supported on the lateral pier support system and the other end capable of being spliced to the main beam section a. the road bridge piers includes a main pier and a lateral pier. The main pier includes a main pier bearing platform 21 and a main pier column 22 disposed on the main pier bearing platform 21. The lateral pier includes a lateral pier bearing platform 31 and a lateral pier column 32 disposed on the lateral pier bearing platform 31.

Figure 5:
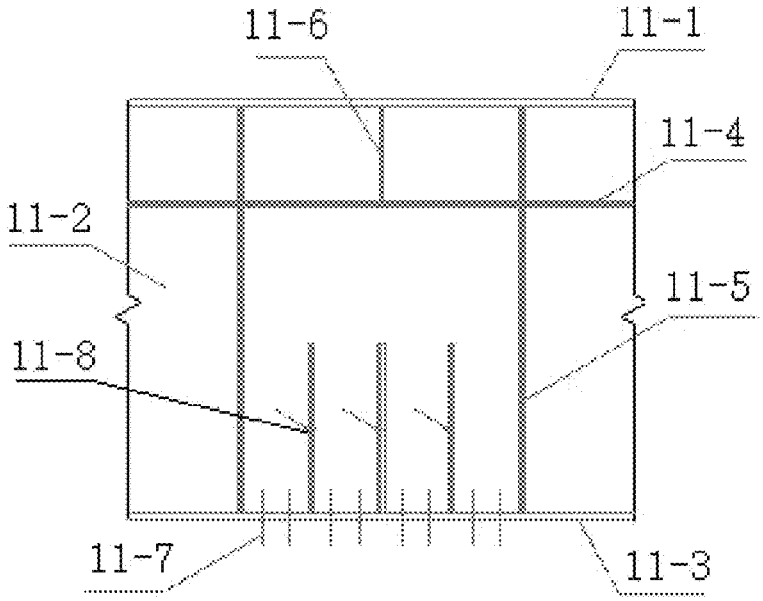
FIG. 5 is a schematic structural diagram of a connecting position of a main beam in a main truss system according to the present invention.
Figure 6:
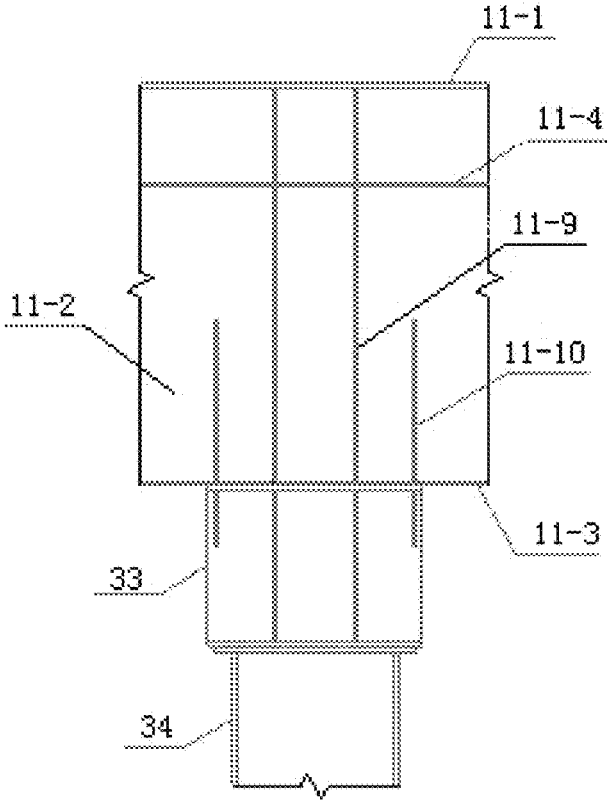
FIG. 6 is a schematic structural diagram of a main beam at a position of a lateral pier according to the present invention.

The main beam 11 uses a double welded I-shaped cross section, and in addition, a three-way reinforcing system is separately disposed on two sides of a main beam web slab 11-2, as shown in FIG. 5 and FIG. 6: 1) A longitudinal reinforcing rib (a main beam longitudinal stiffener 11-4) is disposed at a position 400 mm away from an upper edge of a main beam top slab 11-1. The size of the reinforcing rib is: 200 mm×16 mm. Apart from a splicing area of the main beam 11, the longitudinal reinforcing rib is disposed in continuous, and is interrupted at a vertical reinforcing rib and is welded to the vertical reinforcing rib. 2) A vertical reinforcing rib 11-5 is disposed in the height direction of the main beam web slab. The size of the reinforcing rib is 217 mm×20 mm. A spacing in the length direction of the main beam 11 does not exceed 1.5 m. Apart from a fulcrum area, the remaining part is not less than 1.35 m. 3) A top slab partial support reinforcing rib 11-6 (to counteract the partial support load of the main beam top slab, for example, a support counterforce of a pre-fabricated small box girder, and an operating platform of a concealed bent cap 14) is disposed between the main beam top slab, the vertical reinforcing rib, and the longitudinal reinforcing rib. A spacing (including a spacing from the vertical reinforcing rib) between support reinforcing ribs does not exceed 50 cm and is not less than 40 cm.

A truss support area (that is, a connecting position between the main beam 11 and a main truss system) of the main beam 11 transfers a vertical counterforce and also further needs to bear a relatively large horizontal counterforce, and therefore uses high-strength friction grip bolts for connection. According to calculation, grade 10.9 Φ30 bolts are determined as bottom slab-truss connecting bolts 11-7 arranged on outer side (there is no operating space on an inner side because of the double I-shaped cross section) of the main beam web slab 11-2. The bolts are arranged on each side according to 8×2, and one truss fulcrum partial support stiffener 11-8 is disposed for every 2 rows of bolts (it is ensured that a reinforcing rib is disposed at the periphery of every bolt hole), referring to FIG. 5.

A lateral pier support area (that is, a connecting position between the main beam 11 and the lateral pier support system) of the main beam 11 mainly bears a vertical counterforce. Therefore, only common bolts are disposed. Φ30 is selected for the specification of the bolt. In the main beam 11, two lateral pier fulcrum continuous stiffeners 11-9 corresponding to a web slab of a pad beam are disposed in the lateral pier support area, and two partial bottom slab vertical reinforcing ribs (lateral pier fulcrum partial stiffeners 11-10) corresponding to a pad beam lateral reinforcing ribs, as shown in FIG. 6. In consideration that there is no operating space in the web slab with the double I-shaped cross section, splicing bolt holes of the lateral pier support area are all located on the outer side of the web slab, and six bolts (in two rows, a 4+2 formation, and an inner side bolt is not disposed due to the limitation by operating space of a cushion block stiffener) are disposed on each side.

To reduce the cost of temporary measures and reduce the steel structure usage of the main beam 11, correspondingly a first cantilever beam 12 and a second cantilever beam 13 are separately assembled at two ends of the main beam 11 for use as a construction operation platform and a support platform for a bracket of a part of the concealed bent cap 14. Cantilever beams use a variable-cross section I-shaped structure. To match with the main beam 11, the cantilever beams are in a double state, and the width of a single girder flange slab is consistent with the width of a flange of a single main beam 11 of the main beam 11. The cantilever beams and the main beam 11 are connected by a high-strength bolt.

The main pier support system is disposed on the transverse side of a main pier area and is located under the main beam 11. The lower end of the main pier support system is fixed to the main pier bearing platform 21, whereas the upper end is fixed to the main beam 11. In the drawing, the main pier support system is disposed on the outer side of the main pier column 22 in the transverse direction.

Figure 7:
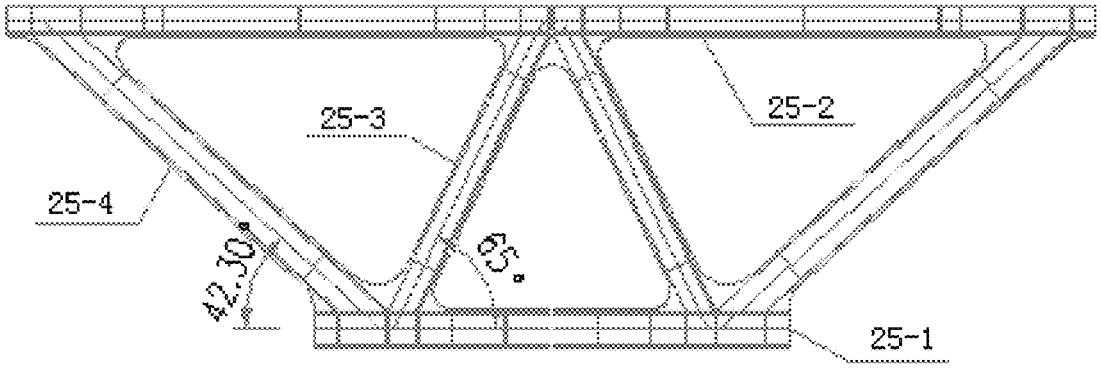
FIG. 7 is a schematic structural diagram of a main truss system according to the present invention.

To meet road bridge support requirements for pre-fabricated small box girder-type concealed bent caps, as shown in FIG. 1 and FIG. 7, the main pier support system in the present invention includes a main pier pad beam 23, a main pier vertical support 24, and a main truss system 25.

Referring to FIG. 7, the main truss system 25 includes a top chord slab, a bottom chord slab, and a W-shaped truss disposed between the top chord slab and the bottom chord slab. Three endpoints of the upper end of the W-shaped truss are all connected and fixed to corresponding positions on the lower surface of the top chord slab, to respectively form a joint site A, a joint site B, and a joint site C. Two endpoints of the lower end of the W-shaped truss are respectively connected and fixed to corresponding positions on the upper surface of the bottom chord slab, to respectively form a joint site E and a joint site F. The upper surface of the top chord slab can be connected to the main beam 11 by a detachable connecting member a. The main pier pad beam 23 is disposed on the transverse side of the road bridge piers, is fixed to the main pier bearing platform 21, and is used for fixing a vertical support column, so that respective positioning and mounting of four scattered columns are transformed into the determination of relative positions of two members, thereby increasing the operating accuracy of on-site mounting. In the present invention, the upper surface of the top chord slab is provided with three connecting portions (connecting flanges), including a connecting portion a, a connecting portion b, and a connecting portion c. The connecting portion a corresponds to the joint site A, the connecting portion b corresponds to the joint site B, and the connecting portion c corresponds to the joint site C. The connecting portion a, the connecting portion b, and the connecting portion c can all be connected to the main beam 11 by the detachable connecting member a. In such an arrangement manner, the W-shaped truss provides three support points for the main beam 11, thereby greatly reducing internal force concentration in a negative bending moment area of the main beam 11 and using the support points to reduce the span (the length from a support point of the main pier to the lateral pier) of the main beam 11. Therefore, a peak bending moment of the main beam 11 appears in a midspan area, and the total bending moment value of the main beam 11 is reduced by 50%, thereby saving the steel usage of the main beam 11.

The W-shaped truss is formed by two external web rods 25-4 and two internal web rods 25-3. The two internal web rods 25-3 form an inverted V-shaped member at a middle position of the W-shaped truss. The two external web rods 25-4 are symmetrically arranged on the outer side of the inverted V-shaped member, and a tilt angle of the external web rod 25-4 relative to a bottom chord rod 25-1 is 42.3° (preferably not less than 40°). In addition, the total length of the truss does not exceed the maximum length of 17 m of a universal flatbed truck, and the length of the bottom chord rod 25-1 is less than that of the bearing platform by about 1 m. Therefore, when it is chosen that the total length of a top chord rod 25-2 is 16 meters and the total height of the W-shaped truss is 5 m (generally does not exceed 5 m), a tilt angle of the internal web rod 25-3 is 65 degrees.

Figure 8:
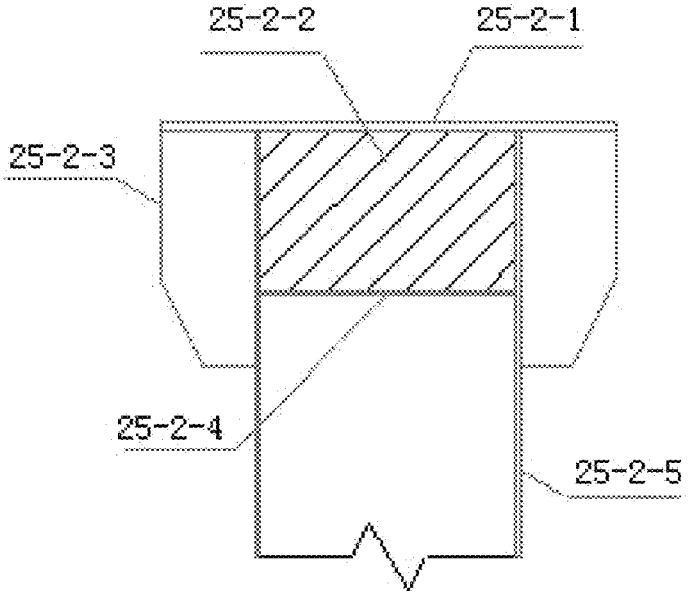
FIG. 8 is a schematic structural diagram of a top chord rod being located in a node area in FIG. 7.
Figure 9:
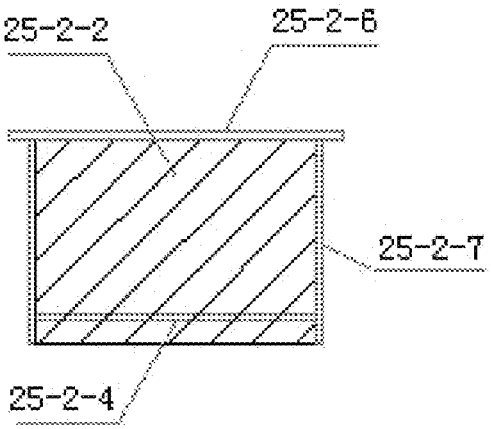
FIG. 9 is a schematic structural diagram of a top chord rod being located in a non-node area in FIG. 7.
Figure 10:
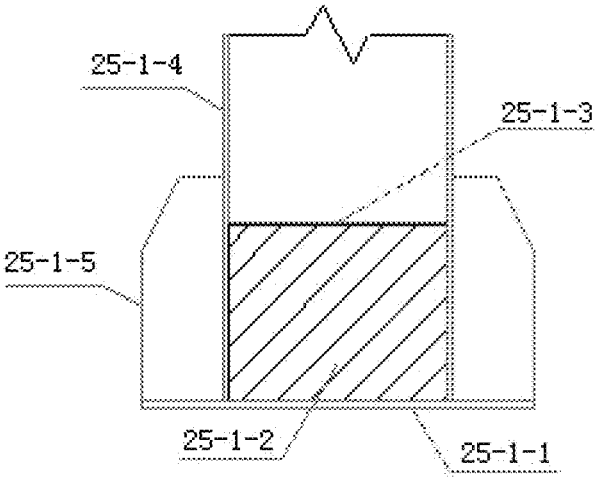
FIG. 10 is a schematic structural diagram of a bottom chord rod being located in a node area in FIG. 7.
Figure 11:
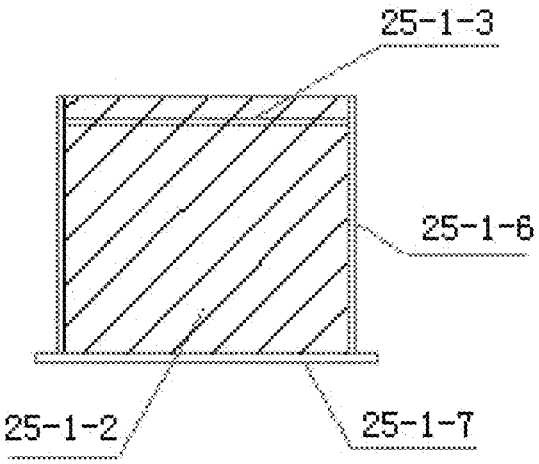
FIG. 11 is a schematic structural diagram of a bottom chord rod being located in a non-node area in FIG. 7.
Figure 12:
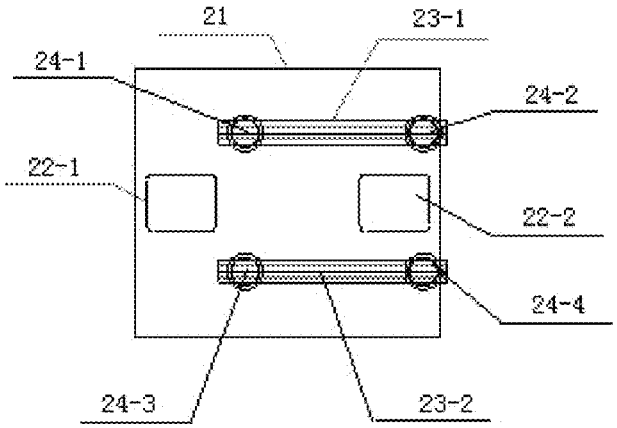
FIG. 12 is a schematic diagram of distribution of a main pier support system (not including a main truss system) on a main pier bearing platform according to an embodiment of the present invention.
Figure 13:
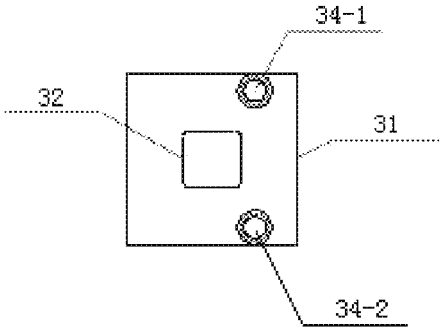
FIG. 13 is a schematic diagram of distribution of a lateral pier support system on a lateral pier bearing platform according to an embodiment of the present invention.

The main truss system 25 is mainly used for bearing an axial force and has relatively large values, and therefore uses a box-shaped structure, to ensure close slenderness ratios inside the plane and outside the plane. To enable connecting structures between the top chord rod and the bottom chord rod 25-1 and the main beam 11 and the pad beam to meet requirements, in a connecting area, the flange slabs extend outward. The top chord rod 25-2 is mainly used for bearing a pulling force, and the bottom chord rod 25-1 is mainly used for bearing a pressure. Therefore, the cross section of the bottom chord rod 25-1 is increased as compared with the cross section of the top chord rod 25-2. That is, the thickness of the cross section of the bottom chord rod 25-1 is greater than that of the cross section of the top chord rod 25-2, referring to FIG. 8 and FIG. 10. The external web rod 25-4 has a large tilt angle and bears a relatively large axial force. Therefore, the cross section (cross slab) of the external web rod 25-4 is increased as compared with the cross section (cross slab) of the internal web rod 25-3. That is, the thickness of the cross slab of the external web rod 25-4 is greater than the thickness of the cross slab of the internal web rod 25-3.

Figure 14:
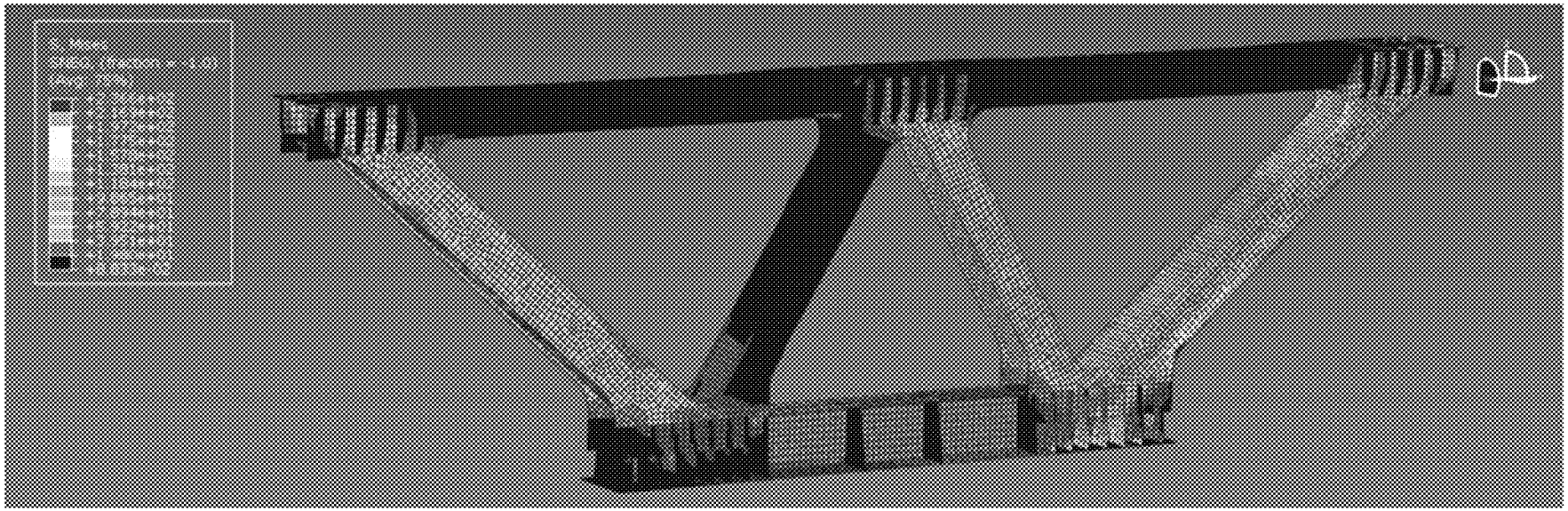
FIG. 14 is an overall stress nephogram of a main truss system.

According to checking of a connecting system between the main beam 11 and the truss, with a bridge pier in which the main truss system 25 bears a peak stress in the road bridge as an example, support counterforces (a vertical axial force and a horizontal shear force) at a connection between the main truss system 25 and the main beam 11 is shown in FIG. 14. As can be seen, a vertical support counterforce between the main truss system 25 and the main beam 11 is slightly susceptible to the stiffness of a spring wire, whereas the horizontal shear force is highly sensitive to the stiffness of the spring wire: when a calculated spring length L is larger and the stiffness of the wire is smaller, the transferred horizontal shear force is smaller (correspondingly, the axial force shared by the main truss system 25 is larger). Therefore, the connecting system between the main beam 11 and the main truss system 25 uses the center of the main beam 11 as a coupling point (the spring length L is 0.75 m). In one aspect, a high-strength bolt friction face with only a single face contact cannot bear an excessive horizontal shear force. In another aspect, the height of the main beam 11 is relatively large, and the stiffness of the coupling between the main beam 11 and the main truss system 25 does not concentrate near the bottom slab.

A stress nephogram of the main truss system 25 is shown in FIG. 14. The main truss system 25 has relatively uniform stress distribution, and a peak stress is only 236 MPa. It means that the structure of the main truss system 25 and the thickness of the slab member are relatively appropriate. The peak stress in the main truss system 25 mainly appears at two ends of a rod member with the maximum internal force: the stress in a node area of the internal web rod 25-3 is only 129 MPa. When the partial point stress at a node of the external web rod 25-4 is greater than 200 MPa, the remaining part has uniform stress distribution.

A number of the main pier vertical supports 24 is two, and the main pier vertical supports 24 are respectively a first main pier vertical support and a second main pier vertical support, both disposed between the lower end of the W-shaped truss and the pad beam. The upper ends of the first main pier vertical support and the second main pier vertical support can both be connected and fixed to the lower surface of the bottom chord slab by a detachable connecting member b, whereas the lower ends of the first main pier vertical support and the second main pier vertical support can be fixed to the main pier pad beam 23 by a detachable connecting member c.

A joint site (connected by a flange connection) between the first main pier vertical support and the bottom chord slab is disposed corresponding to a position of the joint site E, and a joint site (connected by a flange connection) between the second main pier vertical support and the bottom chord slab is disposed corresponding to a position of the joint site F.

The main pier vertical support has two features: 1) The vertical load has a high peak, and a support counterforce at a single point reaches a 500-ton level. 2) The height is relatively small, and the height of the vertical support may be less than 1.0 m. In this case, it is relatively difficult to arrange a lateral support system. Therefore, double HM600 steel is selected as the main pier pad beam 23, to form a stable frame system between the main pier vertical support and the bottom chord slab and the main pier pad beam 23 (the members are all connected by bolts). A spatial frame structure formed by a transverse distribution beam between the lateral supporting of the main truss system 25 and the main pier pad beam 23 ensures the overall stability of the main pier vertical support under the action of the 2500-ton level load.

As shown in FIG. 1 and FIG. 6, the lateral pier support system is disposed on the transverse side of a lateral pier area and is located below the main beam 11. The lower end of the lateral pier support system is fixed to the lateral pier bearing platform 31, whereas the upper end is fixed to the main beam 11. In the drawing, the lateral pier support system is disposed on the outer side of the lateral pier column 32 in the transverse direction.

Specifically, the lateral pier support system includes a lateral pier vertical support 34. The upper end of the lateral pier vertical support 34 is fixed and connected to the main beam 11 by a flange connection by using a bolt fastening member, whereas the lower end is fixed to the lateral pier bearing platform 31 by welding fixation.

There are two types of lateral pier vertical supports 34: 1) One type is conventional support steel pipes, the specifications are generally Φ426, Φ530, Φ609, Φ630, and the like. 2) The other type is formed by nestling conventional support steel pipes. That is, connecting steel slabs with a height not less than 200 mm is disposed at two ends of the support steel pipes, and there are six or more connecting steel slabs in the annular direction. The steel slabs and the flanges are connected by a full-penetration weld joint with a groove.

Figure 15:
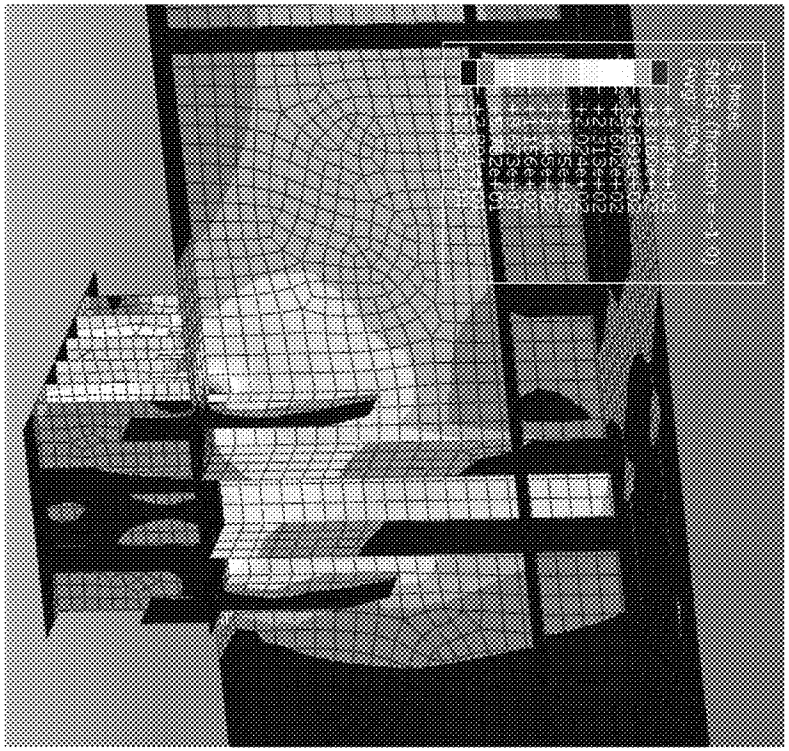
FIG. 15 is a stress nephogram of a main beam in a lateral pier support area.

The lateral pier support area is affected by the bending effect of the main beam 11 to cause nonuniform stress distribution in the support area. Referring to FIG. 15, due to the problem of the support point, a peak stress of the main beam 11 appears near the pad beam connected to the lateral pier vertical support 34. The peak stress is located in a support edge area of the web slab. A local peak stress at a single point reaches 347 MPa, and stresses in the rest are all less than 300 MPa. Therefore, a pad beam system perpendicular to the main beam web slab 11-2 (that is, the pad beam web slab and the main beam web slab 11-2 are arranged at 90°) is disposed. A lateral pier pad beam 33 is formed by using a welded steel box girder with a height of 600 mm. The top and bottom slabs use 800 mm×20 mm, the web slab has a thickness of 20 mm, and a centerline spacing is 30 cm. One support reinforcing rib is disposed on the lateral pier pad beam 33 at an interval of 20 cm in the length direction of the web slab, and at a position corresponding to the main beam web slab 11-2, reinforcing ribs are densely disposed in the cross-sectional direction (the remaining stiffeners are only arranged on the outer side of the web slab). In addition, to adapt to a stress concentration effect caused by the bending of the main beam 11, one longitudinal stiffener is added on the outer side of the top slab, and corresponds to a partial support stiffener of the main beam 11.

To obtain the foregoing cantilever support system, the present invention adopts the following technical solution:

(1) pre-fabricating members:

separately pre-fabricating the following members: one main beam section a, one main beam section b, one main truss system 25, two main pier vertical supports, one main pier pad beam 23, one lateral pier vertical support 34, and two cantilever beams, where the two main pier vertical supports are a first main pier vertical support and a second main pier vertical support; and the two cantilever beams are a first cantilever beam 12 and a second cantilever beam 13;

(2) mounting the main pier pad beam 23, the first main pier vertical support, the second main pier vertical support, and a lateral pier vertical support 34:

hoisting the main pier pad beam 23 to one side of a main pier bearing platform 21 in the transverse direction, adjusting a position of the main pier pad beam 23 on the main pier bearing platform 21, until a mounting hole A and a mounting hole B in the main pier pad beam 23 are respectively aligned with a mounting hole a and a mounting hole b provided in the main pier bearing platform 21, and then fixing the main pier pad beam 23 on the main pier bearing platform 21 by welding fixation; next, hoisting the first main pier vertical support onto the main pier pad beam 23 first, placing the first main pier vertical support sequentially through the mounting hole A in the main pier pad beam 23 and the mounting hole a in the main pier bearing platform 21, and then using a bolt fastening member to fix the lower end of the first main pier vertical support on the main pier bearing platform 21 through the main pier pad beam 23; subsequently hoisting the second main pier vertical support onto the main pier pad beam 23, and placing the second main pier vertical support sequentially through the mounting hole B in the main pier pad beam 23 and the mounting hole b in the main pier bearing platform 21, and then using a bolt fastening member to fix the lower end of the second main pier vertical support on the main pier bearing platform 21 through the main pier pad beam 23; and hoisting the lateral pier vertical support 34 above a lateral pier bearing platform, enabling the lower end of the lateral pier vertical support 34 to be placed through a mounting hole c provided in the lateral pier bearing platform, and then fixing the lateral pier vertical support 34 fixed to the lateral pier bearing platform by welding;

(3) constructing the main truss system 25:

hoisting the main truss system 25 above the first main pier vertical support and the second main pier vertical support, and using a bolt fastening member to separately fix a bottom chord slab of the main truss system 25 to the upper end of the first main pier vertical support and the upper end of the second main pier vertical support;

(4) constructing the main beam section to be joined to the main truss system 25:

hoisting the main beam section a to a top chord slab of the main truss system 25, and adjusting a position of the main beam section a on the top chord slab, until a bolt fastening member can be used to fix the main beam section a to the top chord slab;

(5) constructing the main beam section b with one end to be supported on the lateral pier bearing platform:

hoisting the main beam section b above the lateral pier support system, and adjusting a position of the main beam section b, until one end of the main beam section b can be spliced to the main beam section a, whereas the other end can be fixed to the upper end of the lateral pier support system by a bolt fastening member; and (6) constructing the cantilever beams:

separately hoisting the first cantilever beam 12 and the second cantilever beam 13 in position, then using a detachable connecting member to fix the first cantilever beam 12 to an outer-side end portion of the main beam section a, and using a detachable connecting member to fix the second cantilever beam 13 to an outer-side end portion of the main beam section b.

Figure 2:
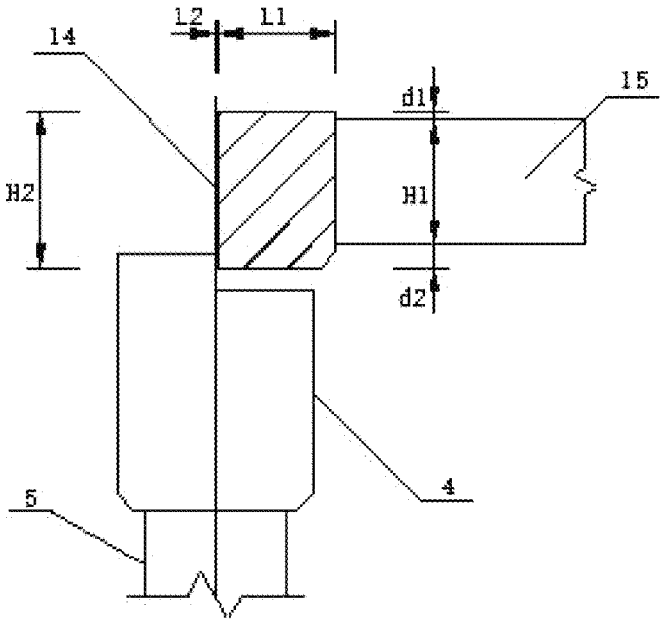
FIG. 2 is a schematic structural diagram of a boundary position between a concealed bent cap and an exposed bent cap of the small box girder-type concealed bent cap in FIG. 1 in a road bridge.

To obtain a small box girder-type concealed bent cap at a boundary position between a concealed bent cap 14 and an exposed bent cap in the road bridge shown in FIG. 2, during construction of the support system in the present invention, the foregoing support system only needs to be constructed on one transverse side (the direction shown in FIG. 2 is the right side) of the road bridge piers.

Figure 3:
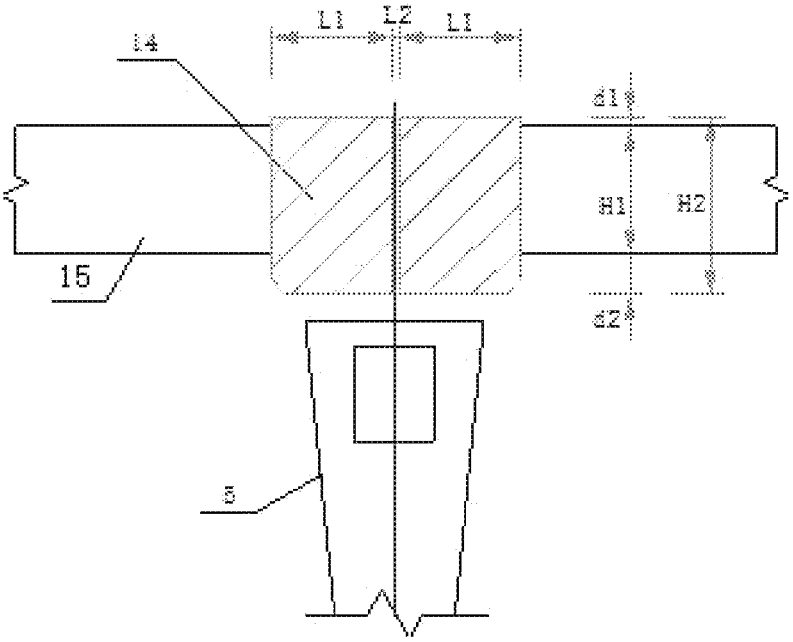
FIG. 3 is a schematic structural diagram of an expansion layer of the small box girder-type concealed bent cap in FIG. 1 in a road bridge.

To obtain a small box girder-type concealed bent cap at an expansion layer in the road bridge shown in FIG. 3, during construction of the support system in the present invention, the foregoing support system needs to be constructed on two transverse sides (the directions shown in FIG. 3 are the left side and the right side) of the road bridge piers. A gap between each support system and an expansion joint meets an area width requirement of the designed concealed bent cap a.

Figure 4:
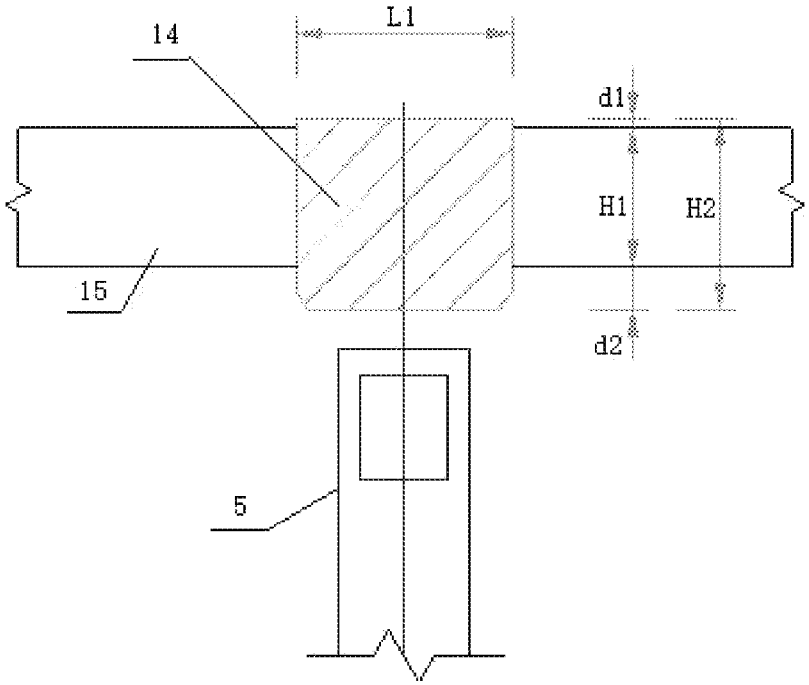
FIG. 4 is a schematic structural diagram of a continuous position of an upper portion structure of the small box girder-type concealed bent cap in FIG. 1 in a road bridge.

To obtain a small box girder-type concealed bent cap at a continuous position of an upper portion structure in the road bridge shown in FIG. 4, during construction of the support system in the present invention, the foregoing support system needs to be constructed on two transverse sides (the directions shown in FIG. 4 are the left side and the right side) of the road bridge piers. A gap between two support systems meets the area width requirement of the designed concealed bent cap a.

Embodiment 2

Figure 16:
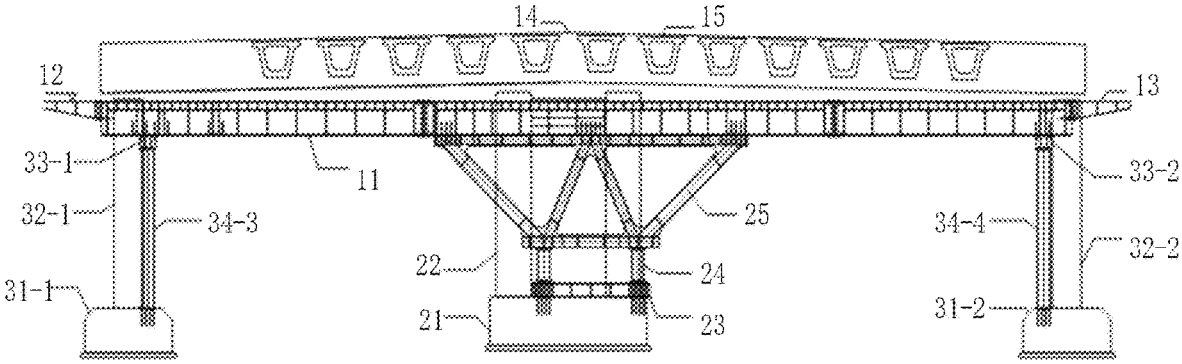
FIG. 16 is a schematic structural diagram of a temporary large-span support system for a road bridge pre-fabricated small box girder-type concealed bent cap according to Embodiment 2 of the present invention.

As shown in FIG. 16, differences between Embodiment 1 and Embodiment 2 of the present invention lie in that the support system in this embodiment is a temporary large-span support system for a road bridge pre-fabricated small box girder-type concealed bent cap. The main beam 11 is formed by splicing three main beam sections. The three main beam sections are a main beam section a, a first main beam section b, and a second main beam section b. The main beam section a is joined to the main truss system 25. One end of the first main beam section b is supported on a lateral pier bearing platform of a first lateral pier, whereas the other end is spliced to one end of the main beam section a. One end of the second main beam section b is supported on the lateral pier bearing platform of a second lateral pier, whereas the other end is spliced to the other end of the main beam section a. In addition, in this embodiment, one lateral pier is separately provided on two sides of a main pier of a road bridge. Therefore, in the support system, one lateral pier support system is disposed for the lateral pier, and one main pier support system is disposed for the main pier. The main beam 11 is supported by the foregoing main pier support system and the lateral pier support systems symmetrically disposed on two sides of the main pier support system.

To obtain the foregoing temporary large-span support system for a road bridge pre-fabricated small box girder-type concealed bent cap, this embodiment uses the following construction method:

(1) pre-fabricating members:

separately pre-fabricating the following members: one main beam section a, two main beam sections b, one main truss system 25, two main pier vertical supports, one main pier pad beam 23, two lateral pier vertical supports 34, and two cantilever beams, where the two main pier vertical supports are a first main pier vertical support and a second main pier vertical support; and the two cantilever beams are a first cantilever beam 12 and a second cantilever beam 13;

the two main beam sections b are a first main beam section b and a second main beam section b; and the two lateral pier vertical supports 34 are a first lateral pier vertical support and a second lateral pier vertical support;

(2) mounting the main pier pad beam 23, the first main pier vertical support, the second main pier vertical support, the first lateral pier vertical support, and the second lateral pier vertical support:

hoisting the main pier pad beam 23 to one side of a main pier bearing platform 21 in the transverse direction, adjusting a position of the main pier pad beam 23 on the main pier bearing platform 21, until a mounting hole A and a mounting hole B in the main pier pad beam 23 are respectively aligned with a mounting hole a and a mounting hole b provided in the main pier bearing platform 21, and then fixing the main pier pad beam 23 on the main pier bearing platform 21 by welding fixation; next, hoisting the first main pier vertical support onto the main pier pad beam 23 first, placing the first main pier vertical support sequentially through the mounting hole A in the main pier pad beam 23 and the mounting hole a in the main pier bearing platform 21, and then using a bolt fastening member to fix the lower end of the first main pier vertical support on the main pier bearing platform 21 through the main pier pad beam 23; subsequently hoisting the second main pier vertical support onto the main pier pad beam 23, and placing the second main pier vertical support sequentially through the mounting hole B in the main pier pad beam 23 and the mounting hole b in the main pier bearing platform 21, and then using a bolt fastening member to fix the lower end of the second main pier vertical support on the main pier bearing platform 21 through the main pier pad beam 23; and hoisting the first lateral pier vertical support above a lateral pier bearing platform of a first lateral pier, enabling the lower end of the first lateral pier vertical support to be placed through a mounting hole c provided in the lateral pier bearing platform of the first lateral pier, and then fixing the first lateral pier vertical support to the lateral pier bearing platform of the first lateral pier by welding; and hoisting the second lateral pier vertical support above the lateral pier bearing platform of a second lateral pier, enabling the lower end of the second lateral pier vertical support to be placed through a mounting hole d provided in the lateral pier bearing platform of the second lateral pier, and then fixing the second lateral pier vertical support to the lateral pier bearing platform of the second lateral pier by welding;

(3) constructing the main truss system 25:

hoisting the main truss system 25 above the first main pier vertical support and the second main pier vertical support, and using a bolt fastening member to separately fix a bottom chord slab of the main truss system 25 to the upper end of the first main pier vertical support and the upper end of the second main pier vertical support;

(4) constructing the main beam sections to be joined to the main truss system 25:

hoisting the main beam section a to a top chord slab of the main truss system 25, and adjusting a position of the main beam section a on the top chord slab, until a bolt fastening member can be used to fix the main beam section a to the top chord slab;

(5) constructing the first main beam section b with one end to be supported on the lateral pier bearing platform of the first lateral pier, and constructing the second main beam section b with one end to be supported on the lateral pier bearing platform of the second lateral pier:

hoisting the first main beam section b above a first lateral pier support system, and adjusting a position of the first main beam section b, until one end of the first main beam section b can be spliced to one end of the main beam section a, whereas the other end can be fixed to the upper end of the first lateral pier support system by a bolt fastening member; and hoisting the second main beam section b above a second lateral pier support system, and adjusting a position of the second main beam section b, until one end of the second main beam section b can be spliced to the other end of the main beam section a, whereas the other end of the second main beam section b can be fixed to the upper end of the second lateral pier support system by a bolt fastening member; and (6) constructing the cantilever beams:

separately hoisting the first cantilever beam 12 and the second cantilever beam 13 in position, then using a detachable connecting member to fix the first cantilever beam 12 to an outer-side end portion of the first main beam section b, and using a detachable connecting member to fix the second cantilever beam 13 to an outer-side end portion of the second main beam section b.

In this embodiment, the structures of the lateral pier support systems, the main pier support system, and other accessories such as the cantilever beams, the main pier pad beam 23, and the lateral pier pad beam 33 are all consistent with those in the technical solution discussed in Embodiment 1. Details are not described herein again.

What is claimed is:

1. A temporary support system for a road bridge pre-fabricated small box girder-type concealed bent cap, the temporary support system comprising a main beam, a main pier support system, and a lateral pier support system, wherein the main beam is arranged on a transverse side of road bridge piers, and the road bridge piers comprise a main pier and a lateral pier;

the main pier support system is disposed on a transverse side of a main pier area and is located under the main beam; a lower end of the main pier support system is fixed to a main pier bearing platform, whereas an upper end is fixed to the main beam;

the lateral pier support system is disposed on a transverse side of a lateral pier area and is located below the main beam; and a lower end of the lateral pier support system is fixed to a lateral pier bearing platform, whereas an upper end is fixed to the main beam, wherein, the main pier support system comprises a main pier pad beam, a main pier vertical support, and a main truss system, wherein the main truss system comprises a top chord slab, a bottom chord slab, and a W-shaped truss disposed between the top chord slab and the bottom chord slab; three endpoints of a upper end of the W-shaped truss are all connected and fixed to corresponding positions on a lower surface of the top chord slab, to respectively form a joint site A, a joint site B, and a joint site C; two endpoints of a lower end of the W-shaped truss are respectively connected and fixed to corresponding positions on an upper surface of the bottom chord slab, to respectively form a joint site E and a joint site F; an upper surface of the top chord slab can be connected to the main beam by a detachable connecting member a; the main pier pad beam is disposed on a transverse side of the road bridge piers and is fixed to the main pier bearing platform;

a number of the main pier vertical support is two, and the main pier vertical supports are respectively a first main pier vertical support and a second main pier vertical support, both disposed between the lower end of the W-shaped truss and the pad beam; and upper ends of the first main pier vertical support and the second main pier vertical support can both be connected and fixed to a lower surface of the bottom chord slab by a detachable connecting member b, whereas lower ends of the first main pier vertical support and the second main pier vertical support can be fixed to the main pier pad beam by a detachable connecting member c.

2. The temporary support system for a road bridge pre-fabricated small box girder-type concealed bent cap according to claim 1, wherein a number of the main beam is two, and the main beams respectively are a first main beam and a second main beam; the first main beam and the second main beam are symmetrically separately disposed on two sides of the road bridge piers in a transverse direction, and the first main beam and the second main beam are connected by a connecting member;

a number of the main pier support system is two, and the main pier support system are respectively a first main pier support system and a second main pier support system; the first main pier support system and the second main pier support system are symmetrically separately disposed on two sides of the road bridge piers in the transverse direction, lower ends of the first main pier support system and the second main pier support system are both fixed to the main pier bearing platform, an upper end of the first main pier support system is fixed to the first main beam, and an upper end of the second main pier support system is fixed to the second main beam;

a number of the lateral pier support system is two, and the lateral pier support systems are respectively a lateral pier support system a and a lateral pier support system b; and the lateral pier support system a and the lateral pier support system b are symmetrically separately disposed on two sides of the road bridge piers in the transverse direction, lower ends of the lateral pier support system a and the lateral pier support system b are both fixed to the lateral pier bearing platform, the upper end of the lateral pier support system a is fixed to the first main beam, and the upper end of the lateral pier support system b is fixed to the second main beam.

3. The temporary support system for a road bridge pre-fabricated small box girder-type concealed bent cap according to claim 1, wherein a joint site between the first main pier vertical support and the bottom chord slab is disposed corresponding to a position of the joint site E, and a joint site between the second main pier vertical support and the bottom chord slab is disposed corresponding to a position of the joint site F.

4. The temporary support system for a road bridge pre-fabricated small box girder-type concealed bent cap according to claim 1, wherein the upper surface of the top chord slab is provided with three connecting portions, comprising a connecting portion a, a connecting portion b, and a connecting portion c; the connecting portion a corresponds to the joint site A, the connecting portion b corresponds to the joint site B, and the connecting portion c corresponds to the joint site C; and the connecting portion a, the connecting portion b, and the connecting portion c can all be connected to the main beam by the detachable connecting member a.

5. The temporary support system for a road bridge pre-fabricated small box girder-type concealed bent cap according to claim 1, wherein the lateral pier support system comprises a lateral pier vertical support; and an upper end of the lateral pier vertical support is fixed and connected to the main beam, whereas a lower end is fixed to the lateral pier bearing platform.

6. The temporary support system for a road bridge pre-fabricated small box girder-type concealed bent cap according to claim 1, wherein a number of the lateral pier is two, and the lateral piers respectively are a first lateral pier and a second lateral pier, the first lateral pier and the second lateral pier are symmetrically distributed on two sides of the main pier; the area of the first lateral pier and the area of the second lateral pier are respectively correspondingly provided with a first lateral pier support system and a second lateral pier support system; an upper end of the first lateral pier support system is fixed to the main beam, whereas a lower end of the first lateral pier is fixed to the lateral pier bearing platform of the first lateral pier; and an upper end of the second lateral pier support system is fixed to the main beam, whereas a lower end of the second lateral pier support system is fixed to the lateral pier bearing platform of the second lateral pier.

7. The temporary support system for a road bridge pre-fabricated small box girder-type concealed bent cap according to claim 1, wherein further comprising two cantilever beams, correspondingly mounted at two ends of the main beam in the length direction by a detachable connection.

8. A method of constructing a cantilever support system for a road bridge pre-fabricated small box girder-type concealed bent cap, the method comprising the following steps:

pre-fabricating members:

separately pre-fabricating the following members: one main beam section a, one main beam section b, one main truss system, two main pier vertical supports, one main pier pad beam, one lateral pier vertical support, and two cantilever beams, wherein the two main pier vertical supports are a first main pier vertical support and a second main pier vertical support; and the two cantilever beams are a first cantilever beam and a second cantilever beam;

mounting the main pier pad beam, the first main pier vertical support, the second main pier vertical support, and the lateral pier vertical support:

hoisting the main pier pad beam to one side of a main pier bearing platform in the transverse direction, adjusting a position of the main pier pad beam on the main pier bearing platform, until a mounting hole A and a mounting hole B in the main pier pad beam are respectively aligned with a mounting hole a and a mounting hole b provided in the main pier bearing platform, and then fixing the main pier pad beam on the main pier bearing platform by welding fixation; next, hoisting the first main pier vertical support onto the main pier pad beam first, placing the first main pier vertical support sequentially through the mounting hole A in the main pier pad beam and the mounting hole a in the main pier bearing platform, and then using a bolt fastening member to fix a lower end of the first main pier vertical support on the main pier bearing platform through the main pier pad beam; subsequently hoisting the second main pier vertical support onto the main pier pad beam, sequentially placing the second main pier vertical support through the mounting hole B in the main pier pad beam and the mounting hole b in the main pier bearing platform, and then using a bolt fastening member to fix a lower end of the second main pier vertical support on the main pier bearing platform through the main pier pad beam; and hoisting the lateral pier vertical support above a lateral pier bearing platform, enabling a lower end of the lateral pier vertical support to be placed through a mounting hole C provided in the lateral pier bearing platform, and then fixing the lateral pier vertical support on the lateral pier bearing platform by welding;

constructing the main truss system:

hoisting the main truss system above the first main pier vertical support and the second main pier vertical support, and using a bolt fastening member to separately fix a bottom chord slab of the main truss system to an upper end of the first main pier vertical support and an upper end of the second main pier vertical support;

constructing the main beam section a to be joined to the main truss system:

hoisting the main beam section a to a top chord slab of the main truss system, and adjusting a position of the main beam section a on the top chord slab, until a bolt fastening member can be used to fix the main beam section a to the top chord slab;

constructing the main beam section b with one end to be supported on the lateral pier bearing platform:

hoisting the main beam section b above a lateral pier support system, and adjusting a position of the main beam section b, until one end of the main beam section b can be spliced to the main beam section a, whereas the other end of the main beam can be fixed to an upper end of the lateral pier support system by a bolt fastening member; and constructing the cantilever beams:

separately hoisting the first cantilever beam and the second cantilever beam in position, then using a detachable connecting member to fix the first cantilever beam to an outer-side end portion of the main beam section a, and using a detachable connecting member to fix the second cantilever beam to an outer-side end portion of the main beam section b.

9. A method of constructing a large-span support system for a road bridge pre-fabricated small box girder-type concealed bent cap, the method comprising the following steps:

pre-fabricating members:

separately pre-fabricating the following members: one main beam section a, two main beam sections b, one main truss system, two main pier vertical supports, one main pier pad beam, two lateral pier vertical supports, and two cantilever beams, wherein the two main pier vertical supports are a first main pier vertical support and a second main pier vertical support; and the two cantilever beams are a first cantilever beam and a second cantilever beam;

the two main beam sections b are a first main beam section b and a second main beam section b; and the two lateral pier vertical supports are a first lateral pier vertical support and a second lateral pier vertical support;

mounting the main pier pad beam, the first main pier vertical support, the second main pier vertical support, the first lateral pier vertical support, and the second lateral pier vertical support:

hoisting the main pier pad beam to one side of a main pier bearing platform in the transverse direction, adjusting a position of the main pier pad beam on the main pier bearing platform, until a mounting hole A and a mounting hole B in the main pier pad beam are respectively aligned with a mounting hole a and a mounting hole b provided in the main pier bearing platform, and then fixing the main pier pad beam on the main pier bearing platform by welding fixation; next, hoisting the first main pier vertical support onto the main pier pad beam first, placing the first main pier vertical support sequentially through the mounting hole A in the main pier pad beam and the mounting hole a in the main pier bearing platform, and then using a bolt fastening member to fix a lower end of the first main pier vertical support on the main pier bearing platform through the main pier pad beam; subsequently hoisting the second main pier vertical support onto the main pier pad beam, sequentially placing the second main pier vertical support through the mounting hole B in the main pier pad beam and the mounting hole b in the main pier bearing platform, and then using a bolt fastening member to fix a lower end of the second main pier vertical support on the main pier bearing platform through the main pier pad beam;

hoisting the first lateral pier vertical support above a lateral pier bearing platform of a first lateral pier, enabling a lower end of the first lateral pier vertical support to be placed through a mounting hole C provided in the lateral pier bearing platform of the first lateral pier, and then fixing the first lateral pier vertical support to the lateral pier bearing platform of the first lateral pier by welding; and hoisting the second lateral pier vertical support above the lateral pier bearing platform of a second lateral pier, enabling a lower end of the second lateral pier vertical support to be placed through a mounting hole d provided in the lateral pier bearing platform of the second lateral pier, and then fixing the second lateral pier vertical support to the lateral pier bearing platform of the second lateral pier by welding;

constructing the main truss system:

hoisting the main truss system above the first main pier vertical support and the second main pier vertical support, and using a bolt fastening member to separately fix a bottom chord slab of the main truss system to an upper end of the first main pier vertical support and an upper end of the second main pier vertical support;

constructing the main beam section a to be joined to the main truss system:

hoisting the main beam section a to a top chord slab of the main truss system, and adjusting a position of the main beam section a on the top chord slab, until a bolt fastening member can be used to fix the main beam section a to the top chord slab;

constructing the first main beam section b with one end to be supported on the lateral pier bearing platform of the first lateral pier, and constructing the second main beam section b with one end to be supported on the lateral pier bearing platform of the second lateral pier:

hoisting the first main beam section b above a first lateral pier support system, and adjusting a position of the first main beam section b, until one end of the first main beam section b can be spliced to one end of the main beam section a, whereas the other end can be fixed to an upper end of the first lateral pier support system by a bolt fastening member; and hoisting the second main beam section b above a second lateral pier support system, and adjusting a position of the second main beam section b, until one end of the second main beam section b can be spliced to the other end of the main beam section a, whereas the other end of the second main beam section b can be fixed to an upper end of the second lateral pier support system by a bolt fastening member; and constructing the cantilever beams:

separately hoisting the first cantilever beam and the second cantilever beam in position, then using a detachable connecting member to fix the first cantilever beam to an outer-side end portion of the first main beam section b, and using a detachable connecting member to fix the second cantilever beam to an outer-side end portion of the second main beam section b.

10. The temporary support system for a road bridge pre-fabricated small box girder-type concealed bent cap according to claim 2, wherein the lateral pier support system comprises a lateral pier vertical support; and an upper end of the lateral pier vertical support is fixed and connected to the main beam, whereas a lower end is fixed to the lateral pier bearing platform.

* * * * *